US007822220B2

(12) United States Patent
Kuo

(10) Patent No.: US 7,822,220 B2
(45) Date of Patent: Oct. 26, 2010

(54) EARPHONE ASSEMBLY

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 1082 days.

(21) Appl. No.: 11/515,581

(22) Filed: Sep. 5, 2006

(65) Prior Publication Data

US 2007/0053541 A1 Mar. 8, 2007

(30) Foreign Application Priority Data

Sep. 5, 2005 (CN) ..... 2005 2 0075292 U

(51) Int. Cl.
*H04R 25/00* (2006.01)

(52) U.S. Cl. ..... 381/384; 381/379

(58) Field of Classification Search ..... 381/370, 381/379, 383, 384; 379/430; 455/575.2; 439/4, 501

See application file for complete search history.

(56) References Cited

U.S. PATENT DOCUMENTS 5,706,353 A * 1/1998 Arai et al. ..... 381/370
6,707,924 B1 * 3/2004 Okiebisu ..... 381/384
6,914,995 B2 * 7/2005 Kao ..... 381/370

* cited by examiner

*Primary Examiner*—Brian Ensey
(74) *Attorney, Agent, or Firm*—Ming Chieh Chang; Wei Te Chung; Andrew C. Cheng

(57) ABSTRACT

An earphone assembly (100) includes an insulative body (1), an audio plug (5) and an earphone (3). The insulative body (1) includes a main body (11), two side walls (12) located at two sides of the main body (11) and a connecting portion (13) connecting with the main body (11) and the two side walls (12). The main body (11), the side walls (12) and the connecting portion (13) together define a receiving space (10). The audio plug (5) is retained in the bottom of the connecting portion (13). The earphone (3) includes two headphones (31) and two rings (33) respectively connecting with the headphones (31) and the audio plug (5). The side walls (12) respectively form a pair of bulges (14) extending transversely and outwardly. The rings (33) include two resilient sections (331) respectively received in the bulges (14) and capable of elastically moving along the extending direction of the bulges (14) for changing the position of the headphones (31).

16 Claims, 7 Drawing Sheets

EARPHONE ASSEMBLY

BACKGROUND OF THE INVENTION

1. Field of the Invention

The present invention relates to an earphone assembly, and particularly to an earphone assembly used for an MP 3 player having different designs and configurations.

2. Description of the Prior Art

With the rapid widespread use of the INTERNET, MP 3 (MPEG-1 Audio Layer-3) becomes the most prevalent music format. Basically, the main advantage is the size of audio files compressed in MP 3 format. There aren't many other formats currently available that can reduce file sizes to the same extent as MP3 while keeping fairly good sound quality. Secondly, MP3 files are downloadable directly from the website. Accordingly, the MP 3 player is widely prevalent among the youngster because of its compact size, good quality, and multi-functions. Usually, the MP 3 player cooperates with an earphone to output the music.

Usually, a conventional earphone comprises a plug mating with the audio jack of an MP 3 player, two headphones, and a string connecting with the plug and the headphones. Such an earphone is inconvenient in use and easy to swing and tangle. In addition, the MP 3 player is usually to be hung around on neck, thus, it is also easy to swing and in some circumstances even to be destroyed especially a hard disk MP 3 player.

Hence, an improved earphone assembly is desired to overcome the disadvantages of the prior art.

BRIEF SUMMARY OF THE INVENTION

Therefore, a main object of the present invention is to provide an earphone assembly having anti-warpped.

To fulfill the above-mentioned object, an earphone assembly includes an insulative body, an audio plug and an earphone. The insulative body comprises a main body, two side walls located at two sides of the main body and a connecting portion connecting with the main body and the two side walls. The main body, the side walls and the connecting portion together define a receiving space. The audio plug is retained in the bottom of the connecting portion. The earphone comprises two headphones and two rings respectively connecting with the headphones and the audio plug. The side walls respectively form a pair of bulges extending transversely and outwardly. The rings comprise two resilient sections respectively received in the bulges and capable of elastically moving along the extending direction of the bulges for changing the position of the headphones.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
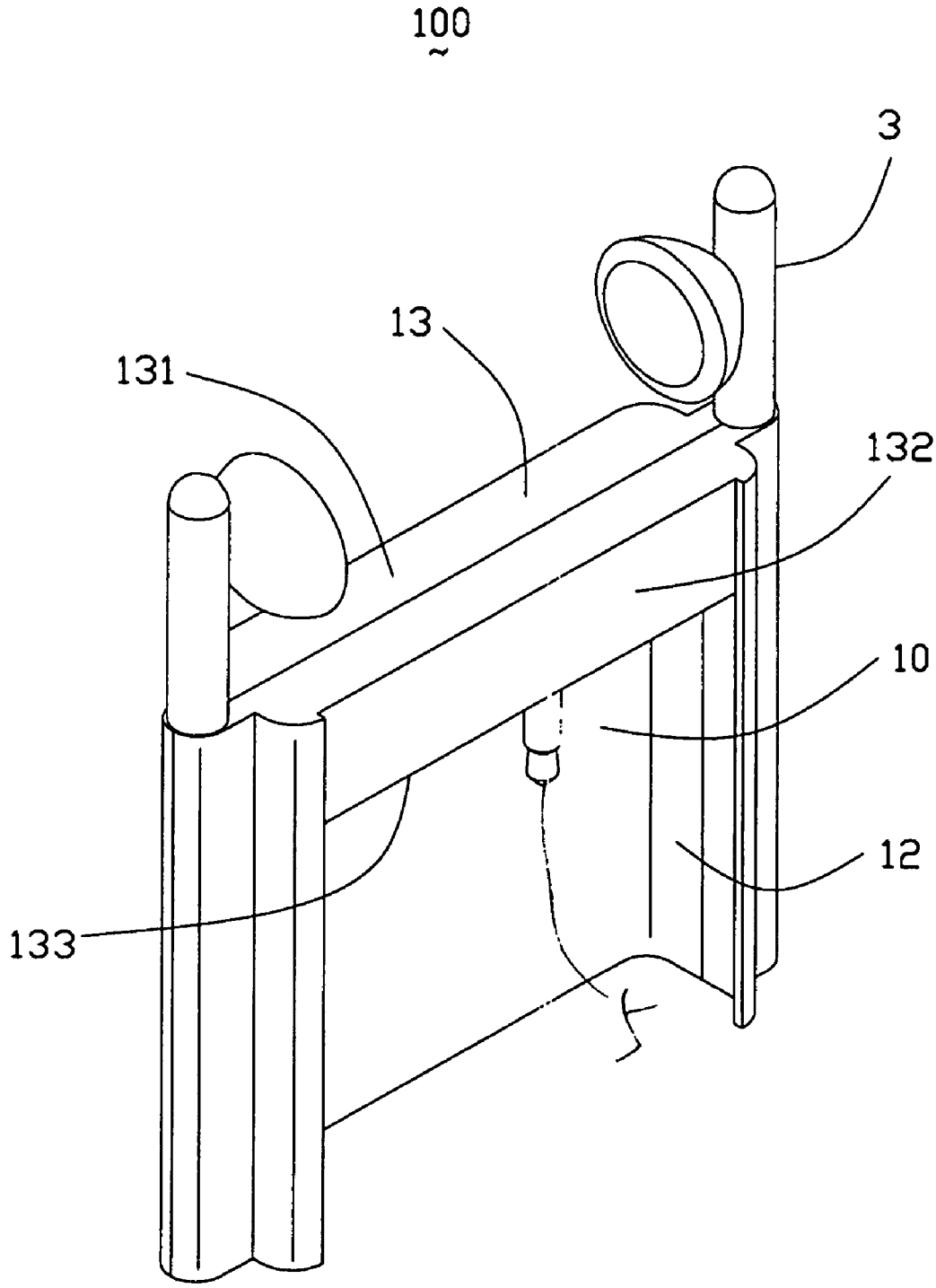
FIG. 1 is an assembled, perspective view of an earphone assembly according to the present invention.
Figure 2:
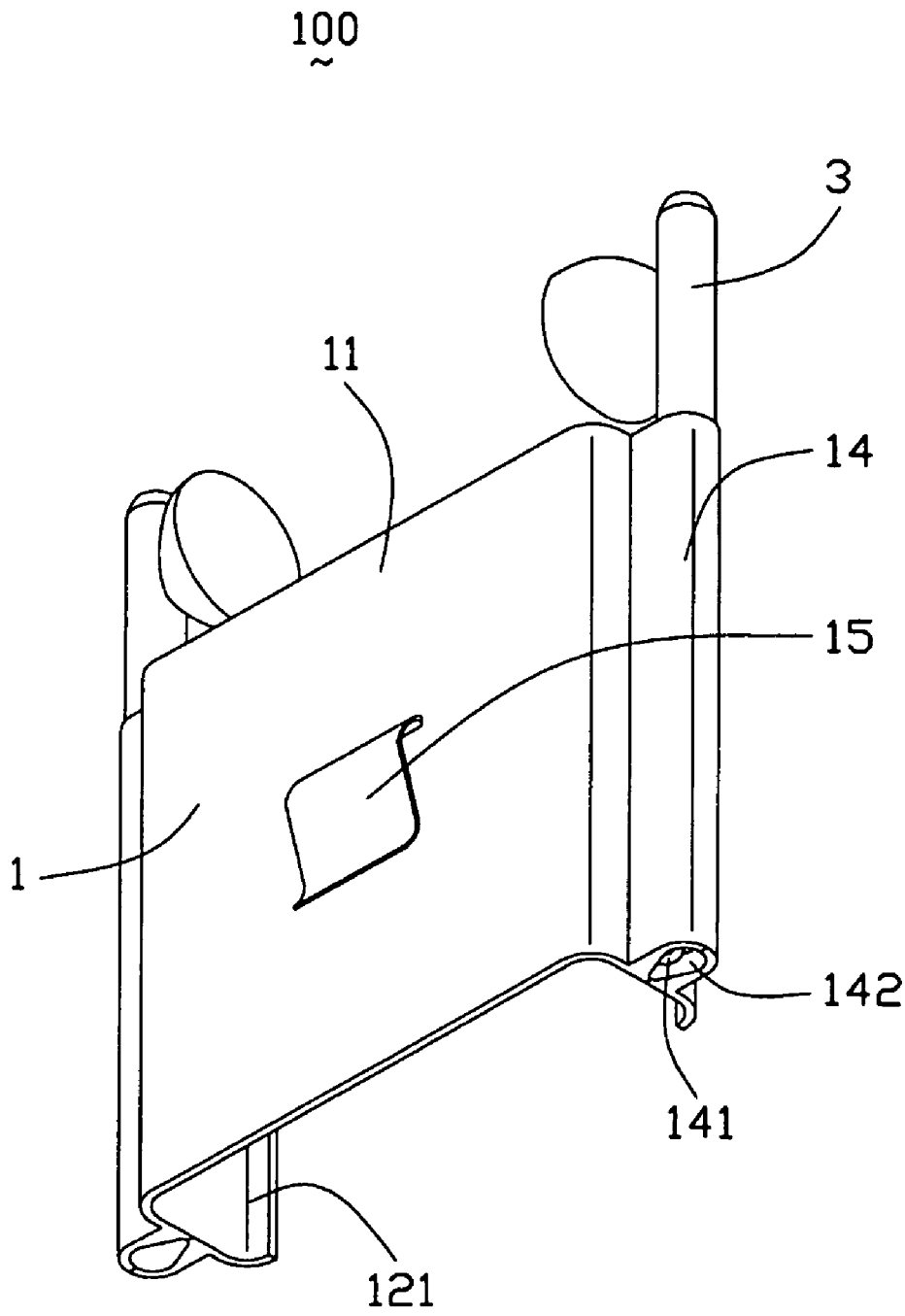
FIG. 2 is a view similar to FIG. 2, but viewed from another aspect.

Referring to FIGS. 1-2, an earphone assembly 100 according to the present invention is adapted for assembling with an MP 3 player, and comprises an insulative body 1, an earphone 3, and an audio plug 5 assembled with the insulative body 1.

Figure 3:
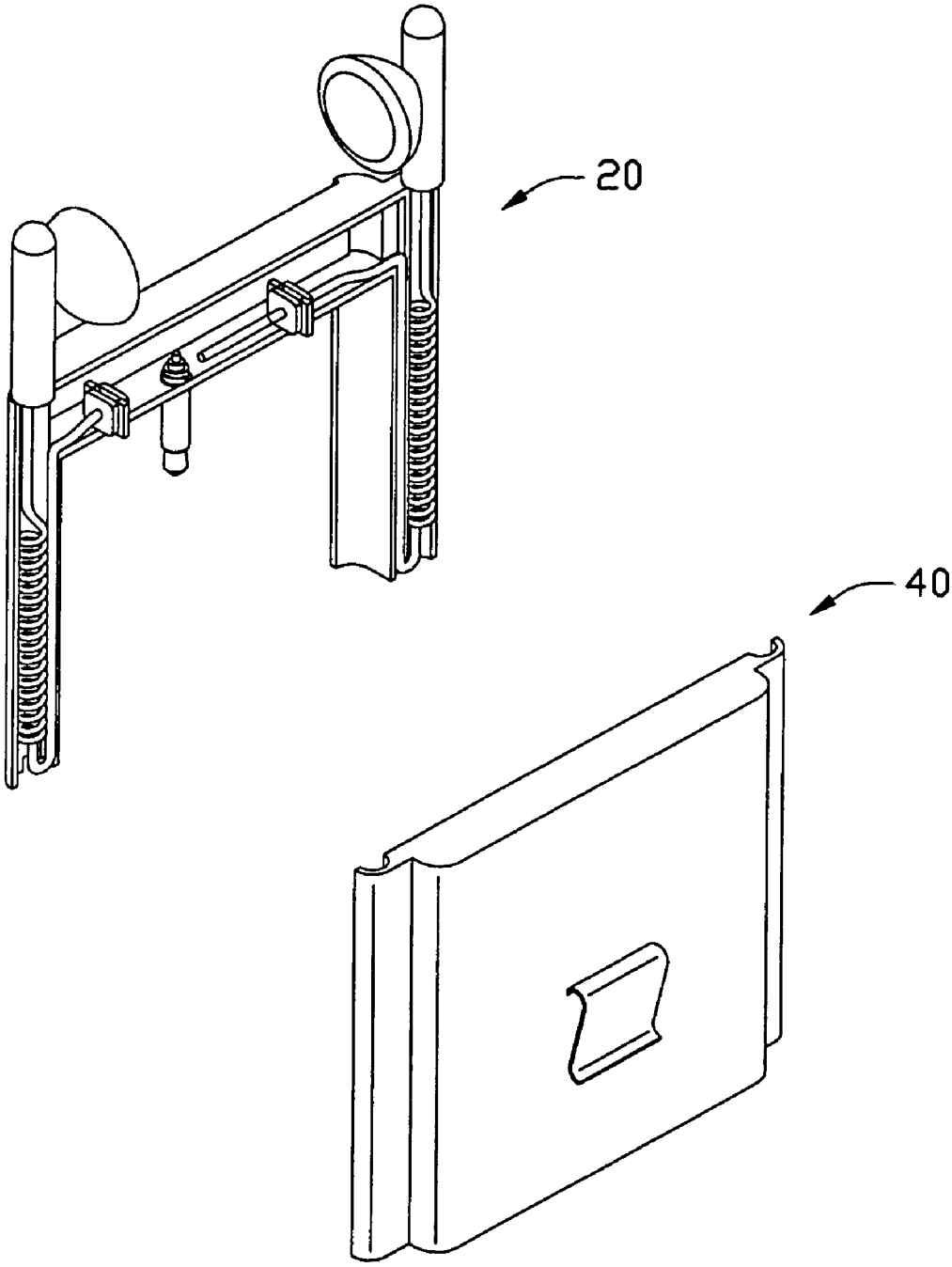
FIG. 3 is a partially exploded, perspective view of FIG. 1.
Figure 4:
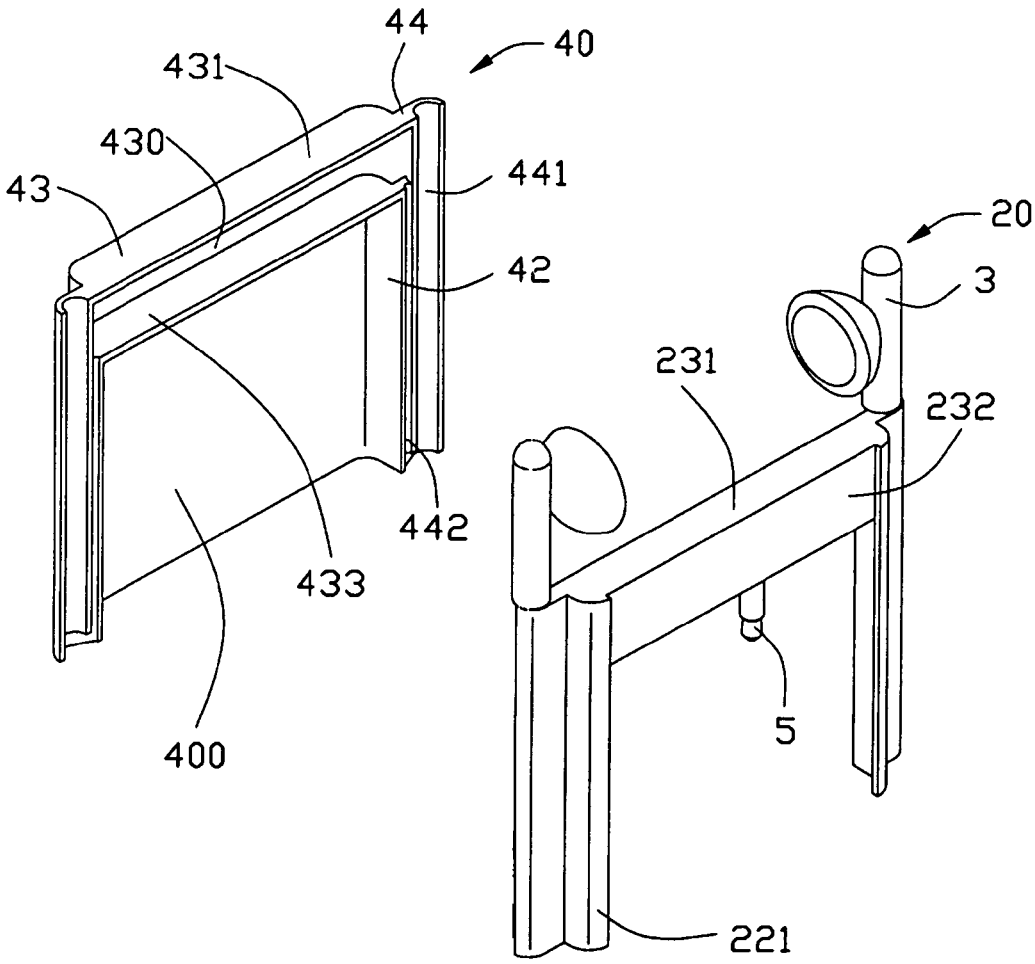
FIG. 4 is a view similar to FIG. 3, but viewed from another aspect.
Figure 5:
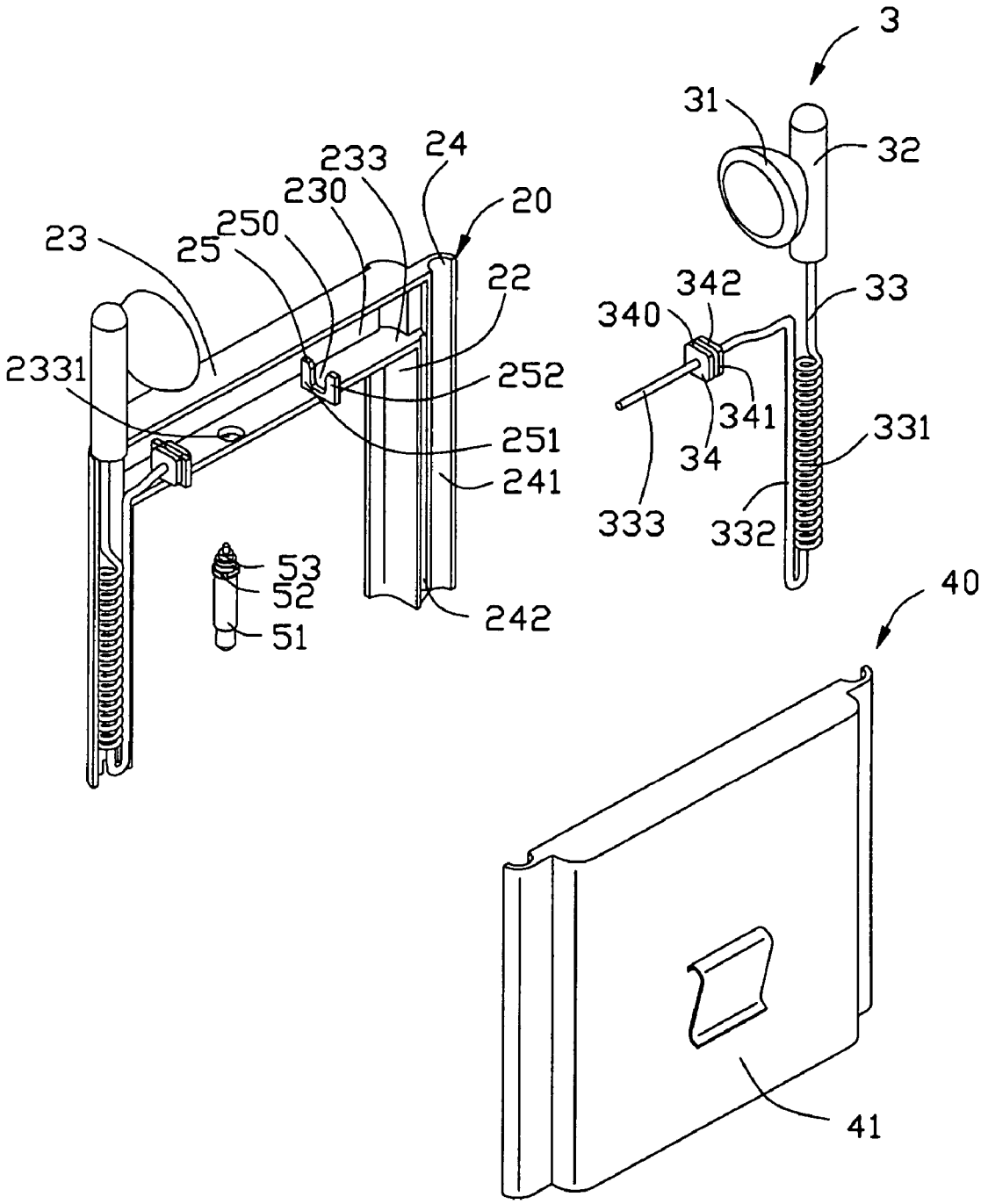
FIG. 5 is an exploded, perspective view of FIG. 1, but viewed from another aspect.

Referring to FIGS. 3-5, the insulative body 1 is constituted of a first shell 20 and a second shell 40. The first shell 20 comprises a connecting portion 23 and two side walls 22 extending downwardly from the distal ends of the connecting portion 23. The connecting portion 23 defines an upper wall 231, a lower wall 233 opposite to the upper wall 231 and a front wall 232 connecting with the upper wall 231 and the lower wall 233. The upper wall 231, lower wall 233, the front wall 232 and side walls 22 together define a receiving chamber 230. The lower wall 233 further defines a bore 2331 for retaining the audio plug 5. A pair of retaining members 25 are respectively disposed at two sides of the lower wall 23, and each comprises a base portion 251 and two upright portions 252 extending upwardly from the base portion 251. The base portion 251 and the upright portions 252 together define a U-shaped recess 250. Particularly referring to FIG. 5, each side wall 22 respectively forms an arc-shaped detaining portion 221 along the back-to-front direction and a bulge 24 extending transversely and outwardly therefrom. Each bulge 24 comprises a first groove 241 and a second groove 242. The first groove 241 and the second groove 242 communicate through the bottom of the bulge 24, and the second groove 242 communicates with the receiving space 230. The second shell 40 has the substantial same structure as the first shell 20, and is respectively designated to main body 41, two side walls 42, a connecting portion 43, a receiving chamber 430, two bulges 44, a first groove 441 and a second groove 442. The main body 41, side walls 42 and the connecting portion 43 together define a receiving space 400. The main body 41 is of rectangular shape.

Referring to FIG. 5, the earphone 3 comprises two headphones 31, two rods 32 assembled with the headphones 31, two rings 33 respectively going through the rods 32 and electrically connecting with the headphones 31 and two engaging portions 34 respectively over-molding on the rings 33. Each ring 33 comprises a spiral resilient section 331, a soldering section 333 and a connecting section 332 connecting with the resilient section 331 and the soldering section 333. The engaging member 34 is disposed at the soldering section 333 and comprises a main portion 340, and the main portion 340 defines a valley 341 along the periphery thereof and a post 342.

Figure 6:
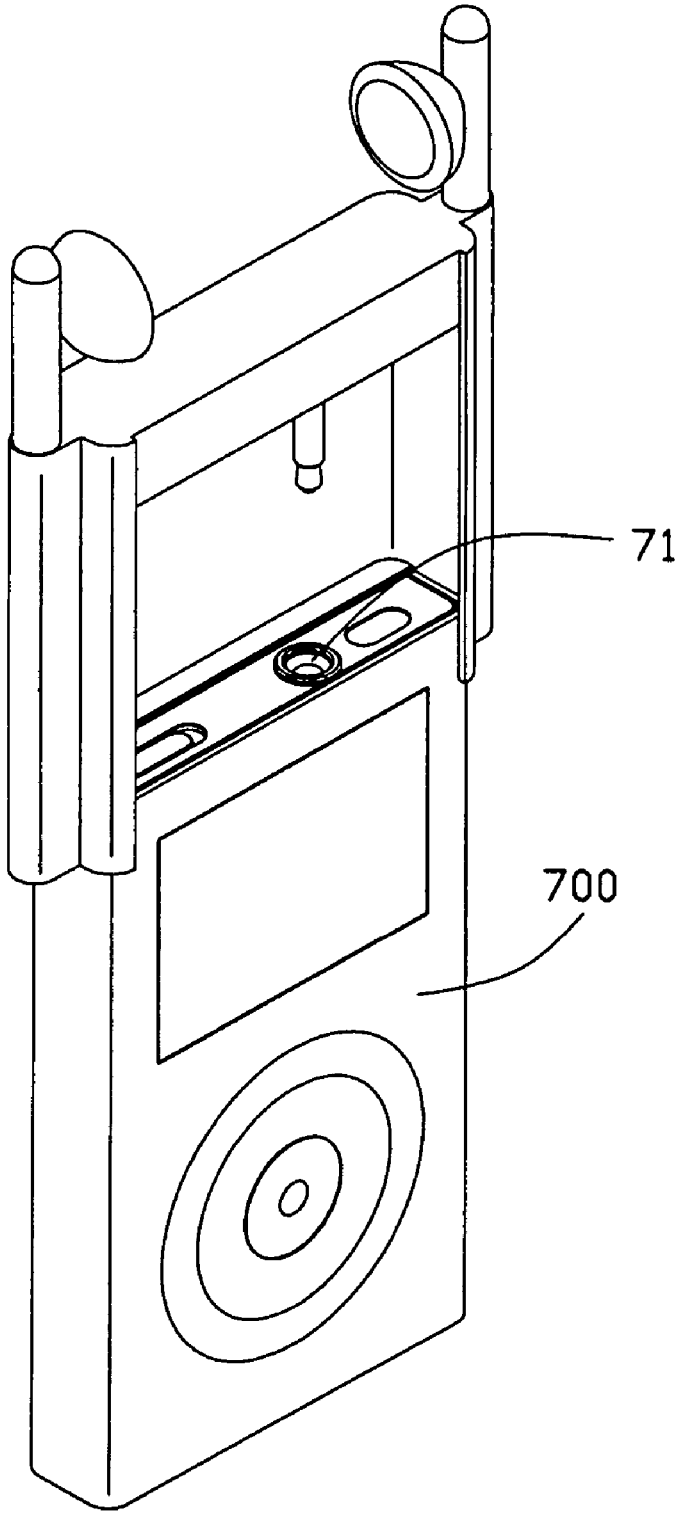
FIG. 6 is a view illustrating the earphone assembly of the present invention partially assembled with an MP 3 player.

Referring to FIGS. 5-6, the audio plug 5 comprises a mating portion 51, a soldering portion 53 and a retaining portion 52 connecting with the mating portion 51 and the soldering portion 53. The mating portion 51 mates with an audio jack 71 of an MP 3 player 700 for transmitting the audio signal to earphone 3. The retaining portion 52 engages with the bore 2331 of the first shell 20.

In assembly, referring to FIGS. 1-5, the retaining portion 52 of the audio plug 5 is retained in the bore 2331 of the first shell 20. The resilient section 331, the connecting section 332, and the soldering section 333 of the ring 33 are respectively received in the first groove 241, the second groove 242, and the receiving chamber 230. The soldering section 333 is further soldered with the soldering portion 53 of the audio plug 5. Then, the post 342 of the engaging member 34 is received and retained in the recess 250, and the base portion 251 and the upright portions 252 of the engaging portion 25 are simultaneously received in the valley 341 of the engaging member 34. Thus, the soldering section 333 of the ring 33 is firmly retained by means of the conjunction between the retaining portion 25 and the engaging member 34. Finally, the second shell 40 is conjugated with the first shell 20 by means of supersonic-melting. The earphone assembly 100 is accomplished by then.

At this time, the side walls 22, the connecting portion 23 and the bulges 24 of the first shell 20 respectively engage with the side walls 42, connecting portion 43 and the bulges 44 of the second shell 40, and then form into two side walls 12, a connecting portion 13 and two bulges 14. The connecting portion 13 comprises an upper wall 131, a lower wall 133 and a front wall 232 connecting with the upper wall 131 and the lower wall 133. The lower wall 133 defines a bore (not shown, corresponding to the bore 2331 of the first shell 20) for receiving the audio plug 5. The first groove 241, the second groove 242 and the receiving chamber 230 of the first shell 20 respectively engage with the first groove 441, the second groove 442 and the receiving chamber 430 of the second shell 40, and then form into a first receiving slot 141, a second receiving slot 142 and a receiving chamber (not shown). The receiving chamber communicates with the second receiving slot 142, the first receiving slot 141 communicates with the second receiving slot 142. The main body 11 (corresponding to the main body 41 of the second shell 40), the side walls 12 and the connecting portion 13 together define a receiving space 10. It needs to point out that the detaining portions 221 of the side walls 22 of the first shell 20 are corresponding to designated to the detaining portions 121. The earphone assembly 100 further comprises a clamp 15 located on the rear side of the main boy 11.

Figure 7:
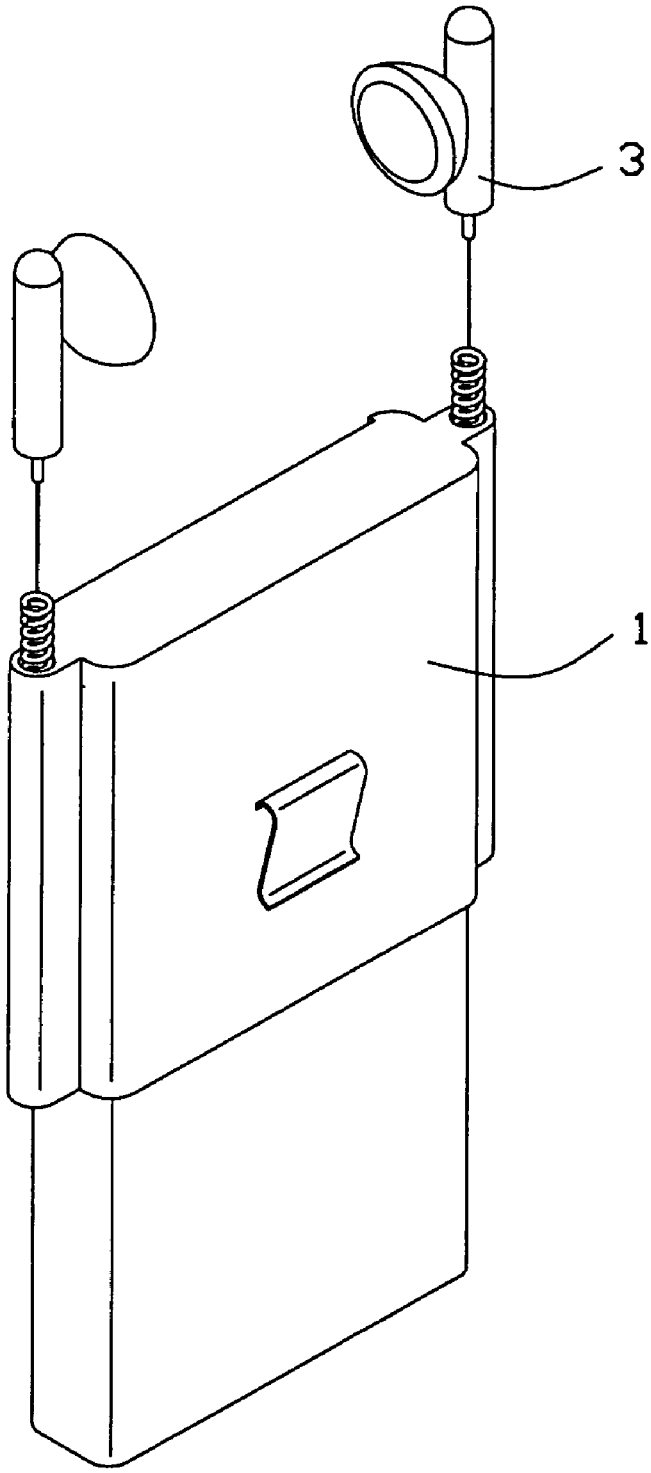
FIG. 7 is a view illustrating using state of the earphone assembly.

Referring to FIGS. 1-2, and in conjunction with FIGS. 5-7, in process of using, the MP 3 player 700 is moved upwardly from the bottom of the earphone assembly 100 and received in the receiving space 10 of the insulative body 1 with the mating portion 51 of the audio plug 5 mating with the audio jack 71 of the MP 3 player 700. When enjoying music, user may take the headphones 31, and the resilient sections 331 of the rings 33 are capable of being pulled longer, whereas the resilient sections 331 are capable of being withdrawn. Thus, such an earphone assembly 100 is very convenient and easy to be used, and free from the trouble of swinging and twisting. In addition, the clamp 15 of the earphone assembly 100 is capable of clipping on the clothes or other objects for retaining the MP 3 player 700.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An earphone assembly, comprising:

an insulative body comprising a main body, two side walls located at two sides of the main body and a connecting portion connecting with the main body and the two side walls, said main body, said side walls and said connecting portion together defining a receiving space;

an audio plug retained in the bottom of the connecting portion;

an earphone comprising two headphones and two rings respectively connecting with the headphones and the audio plug; and wherein said side walls respectively form a pair of bulges extending transversely and outwardly, said rings comprise two resilient sections respectively received in said pair of bulges and capable of elastically moving along the extending direction of the bulges for changing the position of the headphones.

2. The earphone assembly as described in claim 1, wherein the connecting portion of the insulative body defines a receiving chamber, each bulge defines a first receiving slot and a second receiving slot, each ring further comprises a soldering section and a connecting section connecting with the soldering section and the resilient section, and wherein the resilient section, the connecting section and the soldering section are respectively received in the first receiving slot, the second receiving slot and the receiving chamber.

3. The earphone assembly as claimed in claim 2, wherein said receiving chamber communicates with the second receiving slot in the engaging portion, and the first receiving slot communicates with the second receiving slot in the bottom.

4. The earphone assembly as claimed in claim 2, the connecting portion defines a pair of retaining members at distal end of thereof, the rings comprise two engaging members over-molding around the rings and engaging with the retaining member.

5. The earphone assembly as claimed in claim 4, wherein the retaining member defines a U-shaped recess, the engaging member has a post received in the U-shaped recess.

6. The earphone assembly as described in claim 5, wherein the retaining member comprises a base portion and two upright portions extending upwardly from the base portion, and the base portion and the upright portions together define a U-shape recess.

7. The earphone assembly as described in claim 6, wherein the engaging member comprises a rectangular main portion, and the main portion defines a valley along the periphery of thereof and a post, said post is received in the recess, said base portion and the upright portions of the retaining member are received in the valley of the engaging member.

8. The earphone assembly as claimed in claim 2, wherein the resilient section of the ring is a section of resilient spring.

9. The earphone assembly as claimed in claim 2, wherein the connecting portion comprises an upper wall, a lower wall and a front wall connecting with the upper wall and the lower wall, the lower wall defines a bore, the audio plug comprises a mating portion, a retaining portion and a soldering portion, said retaining portion is retained in the bore, said soldering portion electrically connecting with the soldering sections of the rings.

10. The earphone assembly as claimed in claim 1, wherein each wall defines a detaining portion along a back-to-front direction adapted for detaining the MP 3 player.

11. The earphone assembly as claimed in claim 1, further comprising a clamp located on one side of the main body opposite to the side of the receiving space.

12. The earphone assembly as claimed in claim 2, wherein the insulative body is constituted of a first shell and a second shell.

13. The earphone assembly as claimed in claim 12, wherein the first shell and the second shell substantially have the same structure, and each has a first groove, a second groove and a receiving chamber, said first groove, a second groove and the receiving chamber of the first shell and the second shell respectively engage with each other to form the first receiving slot, the second receiving slot and the receiving space of the insulative body.

14. An earphone assembly, comprising:

a music player having an audio jack thereon;

a U-shaped insulative body defining two opposite side walls linked by a middle connecting portion, said U-shaped body being essentially compliantly disposed upon a portion of a contour of said music player;

an audio plug formed on the connecting portion and coupled to the audio jack;

an earphone comprising two headphones, and two extendable/retractable wires respectively connecting with the headphones and the audio plug; and wherein said two extendable/retractable wires are respectively retained in the corresponding side walls.

15. The assembly as claimed in claim 14, wherein the two side walls are respectively located on two sides of the contour.

16. An earphone assembly, comprising:

a music player having an audio jack thereon;

an insulative body being essentially compliantly disposed upon a portion of a contour of said music player;

an audio plug formed on the body and coupled to the audio jack;

an earphone comprising two headphones, and two extendable/retractable wires respectively connecting with the headphones and the audio plug; wherein said two extendable/retractable wires are protectively retained in the body when the body is detached from the body while exposed outside of the body when the body is attached to the body in use.

* * * * *